US011536502B2

(12) United States Patent
Yajima

(10) Patent No.: US 11,536,502 B2
(45) Date of Patent: Dec. 27, 2022

(54) REFRIGERANT CYCLE APPARATUS

(71) Applicant: DAIKIN INDUSTRIES, LTD., Osaka (JP)

(72) Inventor: Ryuuzaburou Yajima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/427,306

(22) PCT Filed: Jan. 27, 2020

(86) PCT No.: PCT/JP2020/002730

§ 371 (c)(1),
(2) Date: Jul. 30, 2021

(87) PCT Pub. No.: WO2020/158653

PCT Pub. Date: Aug. 6, 2020

(65) Prior Publication Data

US 2022/0065506 A1 Mar. 3, 2022

(30) Foreign Application Priority Data

Jan. 31, 2019 (JP) ..... JP2019-016407

(51) Int. Cl.
*F25B 49/00* (2006.01)
*F25B 41/24* (2021.01)
(Continued)

(52) U.S. Cl.
CPC ..... *F25B 49/005* (2013.01); *F24F 11/36* (2018.01); *F25B 41/24* (2021.01); *F25B 41/40* (2021.01);
(Continued)

(58) Field of Classification Search
CPC ..... F25B 41/24; F25B 41/40; F25B 49/02; F25B 2400/0401; F25B 2400/121; F25B 2500/222; F25B 2600/2519; F24F 11/36
See application file for complete search history.

(56) References Cited

U.S. PATENT DOCUMENTS 6,615,597 B1 * 9/2003 Domyo ..... F25B 41/31 62/197
2014/0123685 A1 5/2014 Kim et al.
(Continued)

FOREIGN PATENT DOCUMENTS

EP 1143209 B1 10/2001
EP 3315880 A1 5/2018
(Continued)

OTHER PUBLICATIONS

English translation of International Preliminary Report on Patentability and Written Opinion of the International Searching Authority for International Application No. PCT/JP2020/002730, dated Aug. 12, 2021.
(Continued)

*Primary Examiner* — Henry T Crenshaw
(74) *Attorney, Agent, or Firm* — Birch, Stewart, Kolasch & Birch, LLP

(57) ABSTRACT

An air conditioner includes a use-side unit, a heat source-side unit, refrigerant connection pipes, cutoff valve provided in the refrigerant connection pipes, a refrigerant leakage detector, and a controller control. When the refrigerant leakage detector detects a refrigerant leakage, the controller performs pressure reduction control to lower the pressure of the refrigerant in the use-side unit, and thereafter puts the cutoff valves into a cutoff state.

12 Claims, 3 Drawing Sheets

(51) Int. Cl.
*F24F 11/36* (2018.01)
*F25B 41/40* (2021.01)
*F25B 49/02* (2006.01)

(52) U.S. Cl.
CPC ..... *F25B 49/02* (2013.01); *F25B 2400/0401* (2013.01); *F25B 2400/121* (2013.01); *F25B 2500/222* (2013.01); *F25B 2600/2519* (2013.01)

(56) References Cited

U.S. PATENT DOCUMENTS

| | | | | |
|---|---|---|---|---|
| 2014/0196483 | A1* | 7/2014 | Okazaki | F24F 11/70 62/79 |
| 2015/0233622 | A1* | 8/2015 | Yajima | F25B 49/005 62/129 |
| 2019/0186769 | A1* | 6/2019 | Zimmermann | F24F 11/36 |
| 2019/0186777 | A1* | 6/2019 | Kageyama | F24F 11/77 |
| 2019/0203997 | A1 | 7/2019 | Sakae et al. | |
| 2019/0346165 | A1* | 11/2019 | Obara | F24F 1/0068 |
| 2019/0368752 | A1 | 12/2019 | Shiohama et al. | |
| 2019/0383511 | A1* | 12/2019 | Tomita | F24F 11/52 |
| 2019/0390876 | A1* | 12/2019 | Matsuda | F25B 49/02 |
| 2020/0011580 | A1* | 1/2020 | Matsuda | F25B 13/00 |
| 2020/0109881 | A1* | 4/2020 | Suzuki | F25B 49/005 |

FOREIGN PATENT DOCUMENTS

| | | | |
|---|---|---|---|
| EP | 3 569 944 | A1 | 11/2019 |
| JP | 10-9692 | A | 1/1998 |
| JP | 10-281569 | A | 10/1998 |
| JP | 2000-179971 | A | 6/2000 |
| JP | 2008-170058 | A | 7/2008 |
| JP | 2013-178073 | A | 9/2013 |
| JP | 2014-35171 | A | 2/2014 |
| JP | 2015-75272 | A | 4/2015 |
| JP | 2018-112350 | A | 7/2018 |
| JP | 6361263 | B2 | 7/2018 |
| WO | WO 2018/043721 | A1 | 3/2018 |
| WO | WO 2018/131432 | A1 | 7/2018 |
| WO | WO 2018/131467 | A1 | 7/2018 |

OTHER PUBLICATIONS

International Search Report (PCT/ISA/210) issued in PCT/JP2020/002730 dated Mar. 24, 2020.
The extended European search report dated Feb. 25, 2022, issued in European Application No. 20749588.8.

* cited by examiner

REFRIGERANT CYCLE APPARATUS

TECHNICAL FIELD

The present invention relates to a refrigerant cycle apparatus.

BACKGROUND ART

In a refrigerant cycle apparatus that cools or heats an object or a target fluid by circulating a refrigerant, such as an air conditioner, the refrigerant may leak. This refrigerant leakage becomes a problem depending on the type of refrigerant, and necessary measures need to be taken. For example, Patent Literature 1 (JP 2014-35171 A) takes measures, in an air conditioner using R32 as a refrigerant, to reduce absolute humidity of target space by performing a dehumidifying operation when a refrigerant leakage is detected and to weaken flammability of the refrigerant in the target space.

SUMMARY OF THE INVENTION

Technical Problem

In this way, various measures against the refrigerant leakage have been proposed, and it is required to further enhance safety when the refrigerant leaks.

Solution to Problem

A refrigerant cycle apparatus according to a first aspect includes a use-side unit, a heat source-side unit, a refrigerant connection pipe, a cutoff unit, a refrigerant leakage detection unit, and a control unit. The refrigerant connection pipe connects the use-side unit to the heat source-side unit. The cutoff unit is provided in the refrigerant connection pipe and configured to cut off inflow of a refrigerant into the use-side unit. The refrigerant leakage detection unit detects leakage of the refrigerant from the use-side unit. The control unit performs pressure reduction control, when the refrigerant leakage detection unit detects the leakage of the refrigerant, to lower pressure of the refrigerant in the use-side unit. The control unit puts the cutoff unit into a cutoff state.

Here, when the refrigerant leakage from the use-side unit is detected, first, the pressure reduction control is performed, and the refrigerant pressure in the use-side unit is lowered. This reduces the pressure difference between the installation space of the use-side unit and the refrigerant of the use-side unit, and a leak speed of the refrigerant decreases. Then, natural ventilation in the installation space of the use-side unit discharges most of the leaked refrigerant to the outside.

Furthermore, here, after the pressure reduction control, the cutoff unit is put into the cutoff state. This eliminates the inflow of the refrigerant from the heat source-side unit, and after a while, the refrigerant leakage from the use-side unit completely stops. Therefore, this refrigerant cycle apparatus is more secure when the refrigerant leaks.

The refrigerant cycle apparatus according to a second aspect is the refrigerant cycle apparatus according to the first aspect with the refrigerant connection pipe including a high pressure-side first refrigerant connection pipe and a low pressure-side second refrigerant connection pipe. The cutoff unit includes a first cutoff valve provided in the first refrigerant connection pipe and a second cutoff valve provided in the second refrigerant connection pipe.

Here, two cutoff valves can separate the use-side unit and the heat source-side unit completely. This can eliminate the inflow of refrigerant from the heat source-side unit into the use-side unit and the inflow of refrigerant, air, or the like from the use-side unit into the heat source-side unit.

The refrigerant cycle apparatus according to a third aspect is the refrigerant cycle apparatus according to the first aspect or the second aspect. When the refrigerant leakage detection unit detects the refrigerant leakage, the control unit performs the pressure reduction control to lower the pressure of the refrigerant in the use-side unit, and thereafter puts the cutoff unit into the cutoff state when a predetermined time elapses.

Here, the control unit performs the pressure reduction control until the predetermined time elapses, and thereafter puts the cutoff unit into the cutoff state. If the cutoff unit is put into the cutoff state in an early stage where the pressure of the refrigerant in the use-side unit has not dropped sufficiently, there is a possibility that a large amount of refrigerant may leak into the installation space of the use-side unit. However, here, since the pressure reduction control is performed until a predetermined time elapses, if the predetermined time is set appropriately based on the volume of the refrigerant flow path of the use-side unit, the pressure of the refrigerant in the use-side unit can be sufficiently lowered before the cutoff unit is put into the cutoff state.

The refrigerant cycle apparatus according to a fourth aspect is the refrigerant cycle apparatus according to any one of the first to third aspects. When the refrigerant leakage detection unit detects the leakage of the refrigerant, the control unit performs the pressure reduction control to lower the pressure of the refrigerant in the use-side unit, and thereafter puts the cutoff unit into the cutoff state when the pressure of the refrigerant or a temperature of the refrigerant in the use-side unit satisfies a predetermined condition.

Here, the pressure reduction control is performed until the predetermined condition is satisfied, and thereafter the cutoff unit is put into the cutoff state. If the cutoff unit is put into the cutoff state in an early stage where the pressure of the refrigerant in the use-side unit has not dropped sufficiently, there is a possibility that a large amount of refrigerant may leak into the installation space of the use-side unit. However, here, since the pressure reduction control is performed until the pressure of the refrigerant or the temperature of the refrigerant satisfies the predetermined condition, if the predetermined condition is set appropriately, the pressure of the refrigerant of the use-side unit can be sufficiently lowered before the cutoff unit is put into the cutoff state.

The refrigerant cycle apparatus according to a fifth aspect is the refrigerant cycle apparatus according to any one of the first to fourth aspects. In the pressure reduction control to lower the pressure of the refrigerant in the use-side unit, the control unit performs control to prevent the pressure of the refrigerant in the use-side unit from becoming lower than atmospheric pressure.

Here, control is performed such that the pressure of the refrigerant in the use-side unit is maintained equal to or higher than the atmospheric pressure. This inhibits the defect that air enters from a refrigerant leakage location of the use-side unit, for example, a crack location of the refrigerant pipe, and that the air flows into the refrigerant connection pipe or the heat source-side unit.

The refrigerant cycle apparatus according to a sixth aspect is the refrigerant cycle apparatus according to any one of the first to fifth aspects. The heat source-side unit includes a compressor, a heat source-side heat exchanger, and a heat source-side expansion mechanism. The heat source-side heat exchanger radiates heat from the refrigerant discharged from the compressor. The heat source-side expansion mechanism lowers the pressure of the refrigerant from which heat is radiated by the heat source-side heat exchanger. In the pressure reduction control to lower the pressure of the refrigerant in the use-side unit, the control unit increases the degree of decompression of the refrigerant by the heat source-side expansion mechanism to lower the pressure of the refrigerant flowing from the heat source-side unit to the use-side unit.

Here, in the pressure reduction control, the degree of decompression of the refrigerant by the heat source-side expansion mechanism is increased more than before starting the pressure reduction control. For example, to send the refrigerant coming out of the heat source-side heat exchanger functioning as a radiator to the use-side unit without lowering the pressure as much as possible, the heat source-side expansion mechanism, which is in a fully open state before the pressure reduction control is started, reduces the opening degree in the pressure reduction control to lower the pressure of the refrigerant. By sending the refrigerant whose pressure is lowered in this way from the heat source-side unit to the use-side unit, the pressure of the refrigerant in the use-side unit drops quickly.

The refrigerant cycle apparatus according to a seventh aspect is the refrigerant cycle apparatus according to the sixth aspect. The heat source-side unit further includes a bypass route. The bypass route returns a part of the refrigerant discharged from the compressor and from which heat is radiated by the heat source-side heat exchanger to the compressor without going through the use-side unit. When the refrigerant leakage detection unit detects the leakage of the refrigerant, the control unit performs the pressure reduction control to lower the pressure of the refrigerant in the use-side unit and returns the refrigerant to the compressor by using the bypass route.

Here, in the pressure reduction control, by causing the refrigerant to flow through the bypass route of the heat source-side unit, the amount of refrigerant flowing from the heat source-side unit to the use-side unit is reduced. This quickly lowers the pressure of the refrigerant in the use-side unit.

The refrigerant cycle apparatus according to an eighth aspect is the refrigerant cycle apparatus according to any one of the first to seventh aspects. As the refrigerant, a single refrigerant of R32, R1234yf, R1234ze, or R744, or a mixed refrigerant including the refrigerant is used.

DESCRIPTION OF EMBODIMENT

(1) Configuration of Air Conditioner

Figure 1:
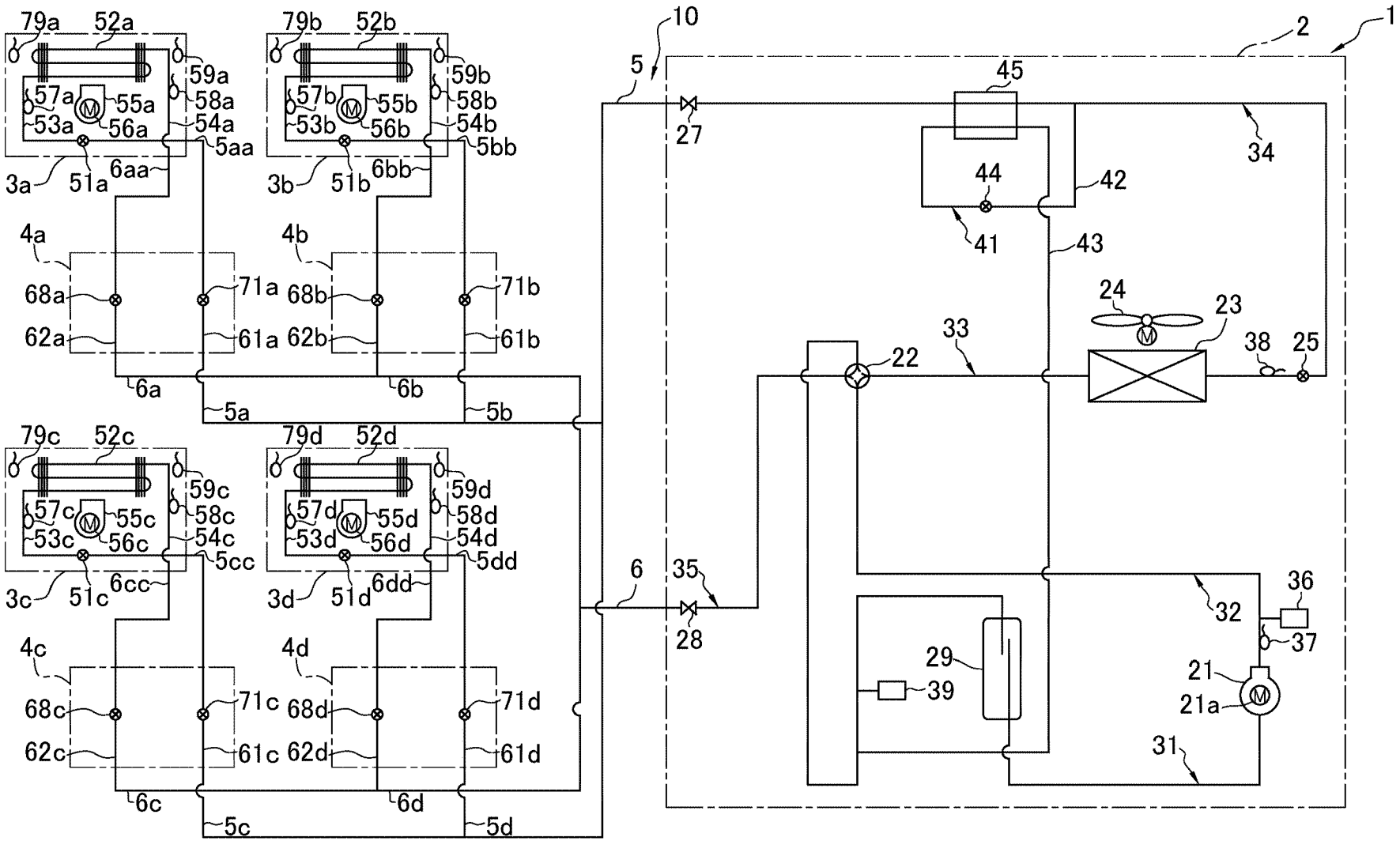
FIG. 1 is a diagram showing a schematic configuration of an air conditioner as one embodiment of a refrigerant cycle apparatus.

FIG. 1 is a diagram showing a schematic configuration of an air conditioner 1 as one embodiment of a refrigerant cycle apparatus. The air conditioner 1 is an apparatus that cools or heats air in a room such as in a building by a vapor compression refrigeration cycle. The air conditioner 1 mainly includes a heat source-side unit 2, a plurality of use-side units 3*a*, 3*b*, 3*c*, and 3*d*, relay units 4*a*, 4*b*, 4*c*, and 4*d* connected to the use-side units 3*a*, 3*b*, 3*c*, and 3*d*, respectively, refrigerant connection pipes 5 and 6, and a control unit 19 (see FIG. 2). The plurality of use-side units 3*a*, 3*b*, 3*c*, and 3*d* is connected to the heat source-side unit 2 in parallel with each other. The refrigerant connection pipes 5 and 6 connect the heat source-side unit 2 to the use-side units 3*a*, 3*b*, 3*c*, and 3*d* via the relay units 4*a*, 4*b*, 4*c*, and 4*d*. The control unit 19 controls components of the heat source-side unit 2, the use-side units 3*a*, 3*b*, 3*c*, and 3*d*, and the relay units 4*a*, 4*b*, 4*c*, and 4*d*. A vapor compression refrigerant circuit 10 of the air conditioner 1 is configured by connection of the heat source-side unit 2, the use-side units 3*a*, 3*b*, 3*c*, and 3*d*, the relay units 4*a*, 4*b*, 4*c*, and 4*d*, and the refrigerant connection pipes 5 and 6.

R32 is charged as the refrigerant. If R32 leaks from the refrigerant circuit 10 into a room (space where the use-side unit is installed) and the concentration of refrigerant in the room increases, flammability of the refrigerant may cause a combustion accident. It is required to prevent this combustion accident.

In the air conditioner 1, the use-side units 3*a*, 3*b*, 3*c*, and 3*d* are switched to a cooling operation or heating operation by a switching mechanism 22 of the heat source-side unit 2.

(1-1) Refrigerant Connection Pipe

The liquid-refrigerant connection pipe 5 mainly includes a combined pipe extending from the heat source-side unit 2, first branch pipes 5*a*, 5*b*, 5*c*, and 5*d*, which are branched into a plurality of (here, four) pipes in front of the relay units 4*a*, 4*b*, 4*c*, and 4*d*, and second branch pipes 5*aa*, 5*bb*, 5*cc*, and 5*dd* connecting the relay units 4*a*, 4*b*, 4*c*, and 4*d* to the use-side units 3*a*, 3*b*, 3*c*, and 3*d*, respectively.

The gas-refrigerant connection pipe 6 mainly includes a combined pipe extending from the heat source-side unit 2, first branch pipes 6*a*, 6*b*, 6*c*, and 6*d*, which are branched into a plurality of (here, four) pipes in front of the relay units 4*a*, 4*b*, 4*c*, and 4*d*, and second branch pipes 6*aa*, 6*bb*, 6*cc*, and 6*dd* connecting the relay units 4*a*, 4*b*, 4*c*, and 4*d* to the use-side units 3*a*, 3*b*, 3*c*, and 3*d*, respectively.

(1-2) Use-Side Unit

The use-side units 3*a*, 3*b*, 3*c*, and 3*d* are installed in a room such as in a building. As described above, the use-side units 3*a*, 3*b*, 3*c*, and 3*d* are connected to the heat source-side unit 2 via the liquid-refrigerant connection pipe 5, the gas-refrigerant connection pipe 6, and the relay units 4*a*, 4*b*, 4*c*, and 4*d*, and constitute part of the refrigerant circuit 10.

Next, the configuration of the use-side units 3*a*, 3*b*, 3*c*, and 3*d* will be described. Note that since the configuration of the use-side unit 3*a* is similar to the configuration of the use-side units 3*b*, 3*c*, and 3*d*, only the configuration of the use-side unit 3*a* will be described here. For the configuration of the use-side units 3*b*, 3*c*, and 3*d*, instead of the subscript "a" indicating each part of the use-side unit 3*a*, the subscript "b", "c", or "d" is added, respectively, and the description of each part will be omitted.

The use-side unit 3*a* mainly includes a use-side expansion valve 51*a* and a use-side heat exchanger 52*a*. In addition, the use-side unit 3*a* includes a use-side liquid refrigerant pipe 53*a* that connects the liquid-side end of the use-side heat exchanger 52*a* to the liquid-refrigerant connection pipe 5 (here, branch pipe 5*aa*), and a use-side gas refrigerant pipe 54*a* that connects the gas-side end of the use-side heat exchanger 52*a* to the gas-refrigerant connection pipe 6 (here, second branch pipe 6*aa*).

The use-side expansion valve 51*a* is an electric expansion valve that can adjust the flow rate of the refrigerant flowing through the use-side heat exchanger 52*a* while decompressing the refrigerant and is provided in the use-side liquid refrigerant pipe 53*a*.

The use-side heat exchanger 52*a* is a heat exchanger that functions as a refrigerant evaporator to cool indoor air or functions as a refrigerant radiator to heat indoor air. Here, the use-side unit 3*a* includes a use-side fan 55*a*. The use-side fan 55*a* supplies the use-side heat exchanger 52*a* with indoor air as a cooling source or a heating source for the refrigerant flowing through the use-side heat exchanger 52*a*. The use-side fan 55*a* is driven by a use-side fan motor 56*a*.

Various sensors are provided in the use-side unit 3*a*. Specifically, the use-side unit 3*a* is provided with a use-side heat exchange liquid-side sensor 57*a* that detects the temperature of the refrigerant at the liquid-side end of the use-side heat exchanger 52*a*, a use-side heat exchange gas-side sensor 58*a* that detects the temperature of the refrigerant at the gas-side end of the use-side heat exchanger 52*a*, and an indoor air sensor 59*a* that detects the temperature of the indoor air sucked into the use-side unit 3*a*. In addition, the use-side unit 3*a* is provided with a refrigerant leakage detection unit 79*a* that detects the leakage of the refrigerant. As the refrigerant leakage detection unit 79*a*, for example, a semiconductor gas sensor or a detection unit that detects a sudden drop in the refrigerant pressure in the use-side unit 3*a* can be adopted. When the semiconductor gas sensor is used, the semiconductor gas sensor is connected to a use-side control unit 93*a* (see FIG. 2). When adopting the detection unit that detects a sudden drop in the refrigerant pressure, a pressure sensor is installed in the refrigerant pipe, and the use-side control unit 93*a* is provided with a detection algorithm for determining a refrigerant leakage from a change in a sensor value of the pressure sensor.

Note that here, the refrigerant leakage detection unit 79*a* is provided in the use-side unit 3*a*, but the present invention is not limited to this example, and the refrigerant leakage detection unit 79*a* may be provided in a remote controller for operating the use-side unit 3*a*, an indoor space where the use-side unit 3*a* performs air conditioning, or the like.

(1-3) Heat Source-Side Unit

The heat source-side unit 2 is installed outdoors of a structure such as a building, for example, on a rooftop or on the ground. The heat source-side unit 2 is connected to the use-side units 3*a*, 3*b*, 3*c*, and 3*d* via the liquid-refrigerant connection pipe 5, the gas-refrigerant connection pipe 6, and the relay units 4*a*, 4*b*, 4*c*, and 4*d* as described above, and constitutes part of the refrigerant circuit 10.

The heat source-side unit 2 mainly includes a compressor 21 and a heat source-side heat exchanger 23. In addition, the heat source-side unit 2 includes the switching mechanism 22 as a cooling and heating switching mechanism for switching between a cooling operation state in which the heat source-side heat exchanger 23 functions as a refrigerant radiator and the use-side heat exchangers 52*a*, 52*b*, 52*c*, and 52*d* function as refrigerant evaporators, and a heating operation state in which the heat source-side heat exchanger 23 functions as a refrigerant evaporator and the use-side heat exchangers 52*a*, 52*b*, 52*c*, and 52*d* function as refrigerant radiators. The switching mechanism 22 and the suction side of the compressor 21 are connected by a suction refrigerant pipe 31. The suction refrigerant pipe 31 is provided with an accumulator 29 that temporarily accumulates the refrigerant sucked into the compressor 21. The discharge side of the compressor 21 and the switching mechanism 22 are connected by a discharge refrigerant pipe 32. The switching mechanism 22 and the gas-side end of the heat source-side heat exchanger 23 are connected by a first heat source-side gas refrigerant pipe 33. The liquid-side end of the heat source-side heat exchanger 23 and the liquid-refrigerant connection pipe 5 are connected by a heat source-side liquid refrigerant pipe 34. A liquid-side shutoff valve 27 is provided at a connection portion of the heat source-side liquid refrigerant pipe 34 with the liquid-refrigerant connection pipe 5. The switching mechanism 22 and the gas-refrigerant connection pipe 6 are connected by a second heat source-side gas refrigerant pipe 35. A gas-side shutoff valve 28 is provided at a connection portion of the second heat source-side gas refrigerant pipe 35 with the gas-refrigerant connection pipe 6. The liquid-side shutoff valve 27 and the gas-side shutoff valve 28 are valves that are manually opened and closed. During operation, the liquid-side shutoff valve 27 and the gas-side shutoff valve 28 are in an open state.

The compressor 21 is a device for compressing the refrigerant. For example, a compressor having a closed structure in which a positive displacement compression element (not shown) such as a rotary type or a scroll type is driven to rotate by a compressor motor 21*a* is used.

The switching mechanism 22 is a device that can switch the flow of refrigerant in the refrigerant circuit 10, and includes, for example, a four-way switching valve. When the heat source-side heat exchanger 23 functions as a refrigerant radiator and the use-side heat exchangers 52*a*, 52*b*, 52*c*, and 52*d* function as a refrigerant evaporator, (hereinafter referred to as "cooling operation state"), the switching mechanism 22 connects the discharge side of the compressor 21 to the gas side of the heat source-side heat exchanger 23 (see the solid line in the switching mechanism 22 in FIG. 1). Meanwhile, when the heat source-side heat exchanger 23 functions as a refrigerant evaporator and the use-side heat exchangers 52*a*, 52*b*, 52*c*, and 52*d* function as a refrigerant radiator, (hereinafter referred to as "heating operation state"), the switching mechanism 22 connects the suction side of the compressor 21 to the gas side of the heat source-side heat exchanger 23 (see the broken line in the first switching mechanism 22 in FIG. 1).

The heat source-side heat exchanger 23 is a heat exchanger that functions as a refrigerant radiator or functions as a refrigerant evaporator. Here, the heat source-side unit 2 includes a heat source-side fan 24. The heat source-side fan 24 sucks outdoor air into the heat source-side unit 2, exchanges heat with the refrigerant in the heat source-side heat exchanger 23, and then discharges the air to the outside. The heat source-side fan 24 is driven by a heat source-side fan motor.

In the cooling operation, the air conditioner 1 causes the refrigerant to flow from the heat source-side heat exchanger 23 to the use-side heat exchangers 52*a*, 52*b*, 52*c*, and 52*d* that function as a refrigerant evaporator through the liquid-refrigerant connection pipe 5 and the relay units 4*a*, 4*b*, 4*c*, and 4*d*. Meanwhile, in the heating operation, the air conditioner 1 causes the refrigerant to flow from the compressor 21 to the use-side heat exchangers 52*a*, 52*b*, 52*c*, and 52*d* that function as a refrigerant radiator through the gas-refrigerant connection pipe 6 and the relay units 4*a*, 4*b*, 4*c*, and 4*d*. In the cooling operation, the switching mechanism 22 is switched to the cooling operation state, the heat source-side heat exchanger 23 functions as a refrigerant radiator, and the refrigerant flows from the heat source-side unit 2 side to the use-side units 3*a*, 3*b*, 3*c*, and 3*d* side through the liquid-refrigerant connection pipe 5 and the relay units 4*a*, 4*b*, 4*c*, and 4*d*. In the heating operation, the switching mechanism 22 is switched to the heating operation state, the refrigerant flows from the use-side units 3*a*, 3*b*, 3*c*, and 3*d* side to the heat source-side unit 2 side through the liquid-refrigerant connection pipe 5 and the relay units 4*a*, 4*b*, 4*c*, and 4*d*, and the heat source-side heat exchanger 23 functions as a refrigerant evaporator.

Here, the heat source-side liquid refrigerant pipe 34 is provided with a heat source-side expansion valve 25. The heat source-side expansion valve 25 is an electric expansion valve that decompresses the refrigerant during the heating operation and is provided in a portion of the heat source-side liquid refrigerant pipe 34 near the liquid-side end of the heat source-side heat exchanger 23.

Furthermore, here, a refrigerant return pipe 41 is connected to the heat source-side liquid refrigerant pipe 34, and a refrigerant cooler 45 is provided. The refrigerant return pipe 41 branches a part of the refrigerant flowing through the heat source-side liquid refrigerant pipe 34 and sends the branched refrigerant to the compressor 21. The refrigerant cooler 45 cools the refrigerant flowing through the heat source-side liquid refrigerant pipe 34 with the refrigerant flowing through the refrigerant return pipe 41. Here, the heat source-side expansion valve 25 is provided in a portion of the heat source-side liquid refrigerant pipe 34 on the heat source-side heat exchanger 23 side with respect to the refrigerant cooler 45.

The refrigerant return pipe 41 is a refrigerant pipe that sends the refrigerant branched from the heat source-side liquid refrigerant pipe 34 to the suction side of the compressor 21. The refrigerant return pipe 41 mainly includes a refrigerant return inlet pipe 42 and a refrigerant return outlet pipe 43. The refrigerant return inlet pipe 42 branches a part of the refrigerant flowing through the heat source-side liquid refrigerant pipe 34 from a portion between the liquid-side end of the heat source-side heat exchanger 23 and the liquid-side shutoff valve 27 (here, a portion between the heat source-side expansion valve 25 and the refrigerant cooler 45), and sends the branched refrigerant to the inlet on the refrigerant return pipe 41 side of the refrigerant cooler 45. The refrigerant return inlet pipe 42 is provided with a refrigerant return expansion valve 44. The refrigerant return expansion valve 44 adjusts the flow rate of the refrigerant flowing through the refrigerant cooler 45 while decompressing the refrigerant flowing through the refrigerant return pipe 41. The refrigerant return expansion valve 44 includes an electric expansion valve. The refrigerant return outlet pipe 43 sends the refrigerant from the outlet on the refrigerant return pipe 41 side of the refrigerant cooler 45 to the suction refrigerant pipe 31. The refrigerant return outlet pipe 43 of the refrigerant return pipe 41 is connected to a portion of the suction refrigerant pipe 31 on the inlet side of the accumulator 29. The refrigerant cooler 45 cools the refrigerant flowing through the heat source-side liquid refrigerant pipe 34 with the refrigerant flowing through the refrigerant return pipe 41.

The heat source-side unit 2 is provided with various sensors. Specifically, the heat source-side unit 2 is provided with a discharge pressure sensor 36 that detects the pressure of the refrigerant discharged from the compressor 21 (discharge pressure), a discharge temperature sensor 37 that detects the temperature of the refrigerant discharged from the compressor 21 (discharge temperature), and a suction pressure sensor 39 that detects the pressure of the refrigerant sucked into the compressor 21 (suction pressure). In addition, the heat source-side unit 2 is provided with a heat source-side heat exchange liquid-side sensor 38 that detects the temperature of the refrigerant at the liquid-side end of the heat source-side heat exchanger 23 (heat source-side heat exchange outlet temperature).

(1-4) Relay Unit

The relay units 4*a*, 4*b*, 4*c*, and 4*d* are installed indoors of a structure, such as a building, for example, in a space in a ceiling cavity of a room. The relay units 4*a*, 4*b*, 4*c*, and 4*d* are interposed between the use-side units 3*a*, 3*b*, 3*c*, and 3*d* and the heat source-side unit 2, respectively, together with the liquid-refrigerant connection pipe 5 and the gas-refrigerant connection pipe 6, and constitute part of the refrigerant circuit 10. The relay units 4*a*, 4*b*, 4*c*, and 4*d* may be disposed near the use-side units 3*a*, 3*b*, 3*c*, and 3*d*, respectively, but may be disposed away from the use-side units 3*a*, 3*b*, 3*c*, and 3*d*, or the relay units 4*a*, 4*b*, 4*c*, and 4*d* may be disposed together in one location.

Next, the configuration of the relay units 4*a*, 4*b*, 4*c*, and 4*d* will be described. Note that since the configuration of the relay unit 4*a* is similar to the configuration of the relay units 4*b*, 4*c*, and 4*d*, only the configuration of the relay unit 4*a* will be described here. For the configuration of the relay units 4*b*, 4*c*, and 4*d*, instead of the subscript "a" in the symbol indicating each part of the relay unit 4*a*, the subscript "b", "c" or "d" is added and the description of each part will be omitted.

The relay unit 4*a* mainly includes a liquid connection pipe 61*a* and a gas connection pipe 62*a*.

The liquid connection pipe 61*a* includes one end thereof connected to the first branch pipe 5*a* of the liquid-refrigerant connection pipe 5, and the other end thereof connected to the second branch pipe 5*aa* of the liquid-refrigerant connection pipe 5. The liquid connection pipe 61*a* is provided with a liquid relay cutoff valve 71*a*. The liquid relay cutoff valve 71*a* is an electric expansion valve.

The gas connection pipe 62*a* includes one end thereof connected to the first branch pipe 6*a* of the gas-refrigerant connection pipe 6, and the other end thereof connected to the second branch pipe 6*aa* of the gas-refrigerant connection pipe 6. The gas connection pipe 62*a* is provided with a gas relay cutoff valve 68*a*. The gas relay cutoff valve 68*a* is an electric expansion valve.

The liquid relay cutoff valve 71*a* and the gas relay cutoff valve 68*a* are fully opened when the cooling operation or heating operation is performed.

(1-5) Control Unit

Figure 2:
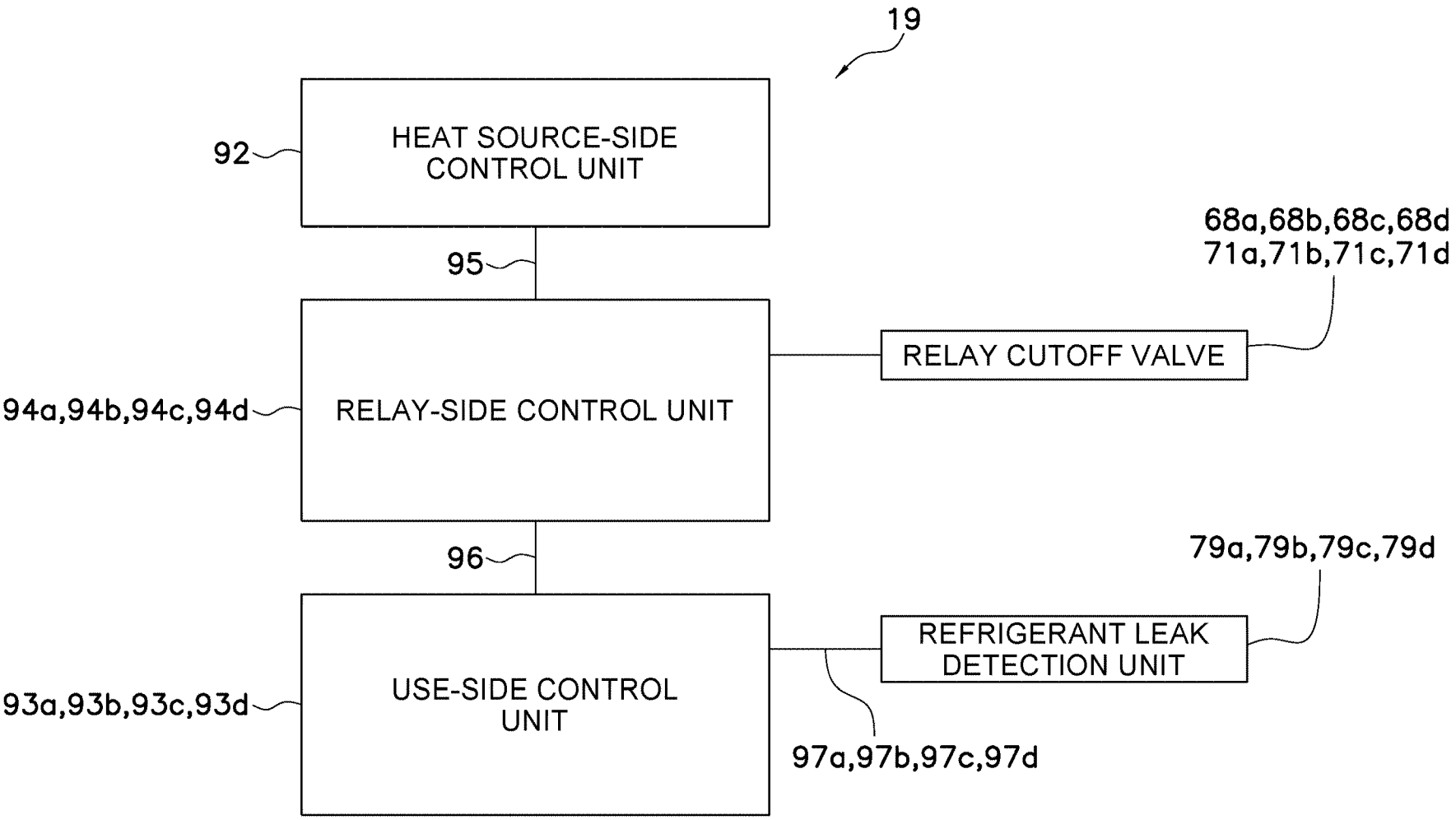
FIG. 2 is a control block diagram of the air conditioner.

The control unit 19 is configured as shown in FIG. 2 by connection of a heat source-side control unit 92, relay-side control units 94*a*, 94*b*, 94*c*, and 94*d*, and use-side control units 93*a*, 93*b*, 93*c*, and 93*d* via transmission lines 95 and 96. The heat source-side control unit 92 controls components of the heat source-side unit 2. The relay-side control units 94*a*, 94*b*, 94*c*, and 94*d* control components of the relay units 4*a*, 4*b*, 4*c*, and 4*d*, respectively. The use-side control units 93*a*, 93*b*, 93*c*, and 93*d* control components of the use-side units 3*a*, 3*b*, 3*c*, and 3*d*, respectively. The heat source-side control unit 92 provided in the heat source-side unit 2, the relay-side control units 94*a*, 94*b*, 94*c*, and 94*d* provided in the relay units 4*a*, 4*b*, 4*c*, and 4*d*, and the use-side control units 93*a*, 93*b*, 93*c*, and 93*d* provided in the use-side units 3*a*, 3*b*, 3*c*, and 3*d*, respectively, can exchange information, such as control signals, with each other via the transmission lines 95 and 96.

The heat source-side control unit 92 includes a control board on which electric components such as a microcomputer and memory are mounted, and various components 21, 22, 24, 25, and 44 and various sensors 36, 37, 38, and 39 of the heat source-side unit 2 are connected. The relay-side control units 94*a*, 94*b*, 94*c*, and 94*d* each include a control board on which electric components such as a microcomputer and memory are mounted, and the gas relay cutoff valves 68*a* to 68*d* and the liquid relay cutoff valves 71*a* to 71*d* of the relay units 4*a*, 4*b*, 4*c*, and 4*d* are connected. The relay-side control units 94*a*, 94*b*, 94*c*, and 94*d* and the heat source-side control unit 92 are connected via the first transmission line 95. The use-side control units 93*a*, 93*b*, 93*c*, and 93*d* each include a control board on which electric components such as a microcomputer and memory are mounted, and various components 51*a* to 51*d*, 55*a* to 55*d*, and various sensors 57*a* to 57*d*, 58*a* to 58*d*, 59*a* to 59*d*, and 79*a* to 79*d* of the use-side units 3*a*, 3*b*, 3*c*, and 3*d* are connected. Here, it is assumed that wires for connecting the refrigerant leakage detection units 79*a*, 79*b*, 79*c*, and 79*d t* to the use-side control units 93*a*, 93*b*, 93*c*, and 93*d* are wires 97*a*, 97*b*, 97*c*, and 97*d*, respectively. The use-side control units 93*a*, 93*b*, 93*c*, and 93*d* and the relay-side control units 94*a*, 94*b*, 94*c*, and 94*d* are connected via the second transmission line 96, respectively.

In this way, the control unit 19 controls the operation of the entire air conditioner 1. Specifically, based on detection signals of various sensors 36, 37, 38, 39, 57*a* to 57*d*, 58*a* to 58*d*, 59*a* to 59*d*, 79*a* to 79*d*, and the like as described above, the control unit 19 controls various components 21, 22, 24, 25, 44, 51*a* to 51*d*, 55*a* to 55*d*, 68*a* to 68*d*, and 71*a* to 71*d* of the air conditioner 1 (here, heat source-side unit 2, use-side units 3*a*, 3*b*, 3*c*, and 3*d*, and relay units 4*a*, 4*b*, 4*c*, and 4*d*).

(2) Basic Operation of Air Conditioner

Next, a basic operation of the air conditioner 1 will be described. The basic operation of the air conditioner 1 includes the cooling operation and the heating operation, as described above. Note that the basic operation of the air conditioner 1 described below is performed by the control unit 19 that controls components of the air conditioner 1 (heat source-side unit 2, use-side units 3*a*, 3*b*, 3*c*, and 3*d*, and relay units 4*a*, 4*b*, 4*c*, and 4*d*).

(2-1) Cooling Operation

During the cooling operation, for example, when all of the use-side units 3*a*, 3*b*, 3*c*, and 3*d* perform the cooling operation, (operation in which all of the use-side heat exchangers 52*a*, 52*b*, 52*c*, and 52*d* function as refrigerant evaporators and the heat source-side heat exchanger 23 functions as a refrigerant radiator), the switching mechanism 22 is switched to the cooling operation state (state indicated by the solid line of the switching mechanism 22 in FIG. 1), and the compressor 21, the heat source-side fan 24, and the use-side fans 55*a*, 55*b*, 55*c*, and 55*d* are driven. The liquid relay cutoff valves 71*a*, 71*b*, 71*c*, and 71*d* and the gas relay cutoff valves 68*a*, 68*b*, 68*c*, and 68*d* of the relay units 4*a*, 4*b*, 4*c*, and 4*d* are fully opened.

Here, various devices of the use-side units 3*a*, 3*b*, 3*c*, and 3*d* are operated by the use-side control units 93*a*, 93*b*, 93*c*, and 93*d*, respectively. The use-side control units 93*a*, 93*b*, 93*c*, and 93*d* transmit information indicating that the use-side units 3*a*, 3*b*, 3*c*, and 3*d* will perform the cooling operation to the heat source-side control unit 92 and the relay-side control units 94*a*, 94*b*, 94*c*, and 94*d* via the transmission lines 95 and 96, respectively. Various devices of the heat source-side unit 2 and the relay units 4*a*, 4*b*, 4*c*, and 4*d* are operated by the heat source-side control unit 92 and the relay-side control units 94*a*, 94*b*, 94*c*, and 94*d* that receive the information from the use-side units 3*a*, 3*b*, 3*c*, and 3*d*, respectively.

During the cooling operation, the high-pressure refrigerant discharged from the compressor 21 is sent to the heat source-side heat exchanger 23 through the switching mechanism 22. The refrigerant sent to the heat source-side heat exchanger 23 condenses by being cooled by heat exchange with outdoor air supplied by the heat source-side fan 24 in the heat source-side heat exchanger 23 that functions as a refrigerant radiator. This refrigerant flows out of the heat source-side unit 2 through the heat source-side expansion valve 25, the refrigerant cooler 45, and the liquid-side shutoff valve 27. At this time, in the refrigerant cooler 45, the refrigerant flowing out of the heat source-side unit 2 is cooled by the refrigerant flowing through the refrigerant return pipe 41.

The refrigerant flowing out of the heat source-side unit 2 is branched and sent to the relay units 4*a*, 4*b*, 4*c*, and 4*d* through the liquid-refrigerant connection pipe 5 (combined pipe and first branch pipes 5*a*, 5*b*, 5*c*, and 5*d*). The refrigerant sent to the relay units 4*a*, 4*b*, 4*c*, and 4*d* flows out of the relay units 4*a*, 4*b*, 4*c*, and 4*d* through the liquid relay cutoff valves 71*a*, 71*b*, 71*c*, and 71*d*, respectively.

The refrigerant flowing out of the relay units 4*a*, 4*b*, 4*c*, and 4*d* is sent to the use-side units 3*a*, 3*b*, 3*c*, and 3*d* through the second branch pipes 5*aa*, 5*bb*, 5*cc*, and 5*dd* (portion of the liquid-refrigerant connection pipe 5 that connects the relay units 4*a*, 4*b*, 4*c*, and 4*d* to the use-side units 3*a*, 3*b*, 3*c*, and 3*d*), respectively. The refrigerant sent to the use-side units 3*a*, 3*b*, 3*c*, and 3*d* is decompressed by the use-side expansion valves 51*a*, 51*b*, 51*c*, and 51*d*, and is then sent to the use-side heat exchangers 52*a*, 52*b*, 52*c*, and 52*d*, respectively. The refrigerant sent to the use-side heat exchangers 52*a*, 52*b*, 52*c*, and 52*d* evaporates by being heated by exchanging heat with indoor air supplied from inside the room by the use-side fans 55*a*, 55*b*, 55*c*, and 55*d* in the use-side heat exchangers 52*a*, 52*b*, 52*c*, and 52*d* that function as refrigerant evaporators, respectively. The evaporated refrigerant flows out of the use-side units 3*a*, 3*b*, 3*c*, and 3*d*. Meanwhile, the indoor air cooled by the use-side heat exchangers 52*a*, 52*b*, 52*c*, and 52*d* is sent into the room, thereby cooling the room.

The refrigerant flowing out of the use-side units 3*a*, 3*b*, 3*c*, and 3*d* is sent to the relay units 4*a*, 4*b*, 4*c*, and 4*d* through the second branch pipes 6*aa*, 6*bb*, 6*cc*, and 6*dd* of the gas-refrigerant connection pipe 6, respectively. The refrigerant sent to the relay units 4*a*, 4*b*, 4*c*, and 4*d* flows out of the relay units 4*a*, 4*b*, 4*c*, and 4*d* through the gas relay cutoff valves 68*a*, 68*b*, 68*c*, and 68*d*, respectively.

The refrigerant flowing out of the relay units 4*a*, 4*b*, 4*c*, and 4*d* is sent to the heat source-side unit 2 in a combined state through the gas-refrigerant connection pipe 6 (combined pipe and first branch pipes 6*a*, 6*b*, 6*c*, and 6*d*). The refrigerant sent to the heat source-side unit 2 is sucked into the compressor 21 through the gas-side shutoff valve 28, the switching mechanism 22, and the accumulator 29.

(2-2) Heating Operation

During the heating operation, for example, when all of the use-side units 3*a*, 3*b*, 3*c*, and 3*d* perform the heating operation, (operation in which all of the use-side heat exchangers 52*a*, 52*b*, 52*c*, and 52*d* function as refrigerant radiators and the heat source-side heat exchanger 23 functions as a refrigerant evaporator), the switching mechanism 22 is switched to the heating operation state (state indicated by the broken line of the switching mechanism 22 in FIG. 1), and the compressor 21, the heat source-side fan 24, and the use-side fans 55*a*, 55*b*, 55*c*, and 55*d* are driven. The liquid relay cutoff valves 71*a*, 71*b*, 71*c*, and 71*d* and the gas relay cutoff valves 68*a*, 68*b*, 68*c*, and 68*d* of the relay units 4*a*, 4*b*, 4*c*, and 4*d* are fully opened.

Here, various devices of the use-side units 3*a*, 3*b*, 3*c*, and 3*d* are operated by the use-side control units 93*a*, 93*b*, 93*c*, and 93*d*, respectively. The use-side control units 93*a*, 93*b*, 93*c*, and 93*d* transmit information indicating that the use-side units 3*a*, 3*b*, 3*c*, and 3*d* will perform the heating operation to the heat source-side control unit 92 and the relay-side control units 94*a*, 94*b*, 94*c*, and 94*d* via the transmission lines 95 and 96. Various devices of the heat source-side unit 2 and the relay units 4*a*, 4*b*, 4*c*, and 4*d* are operated by the heat source-side control unit 92 and the relay-side control units 94*a*, 94*b*, 94*c*, and 94*d* that receive the information from the use-side units 3*a*, 3*b*, 3*c*, and 3*d*, respectively.

The high-pressure refrigerant discharged from the compressor 21 flows out of the heat source-side unit 2 through the switching mechanism 22 and the gas-side shutoff valve 28.

The refrigerant flowing out of the heat source-side unit 2 is sent to the relay units 4*a*, 4*b*, 4*c*, and 4*d* through the gas-refrigerant connection pipe 6 (combined pipe and first branch pipes 6*a*, 6*b*, 6*c*, and 6*d*). The refrigerant sent to the relay units 4*a*, 4*b*, 4*c*, and 4*d* flows out of the relay units 4*a*, 4*b*, 4*c*, and 4*d* through the gas relay cutoff valves 68*a*, 68*b*, 68*c*, and 68*d*, respectively.

The refrigerant flowing out of the relay units 4*a*, 4*b*, 4*c*, and 4*d* is sent to the use-side units 3*a*, 3*b*, 3*c*, and 3*d* through the second branch pipes 6*aa*, 6*bb*, 6*cc*, and 6*dd* (portion of the gas-refrigerant connection pipe 6 that connects the relay units 4*a*, 4*b*, 4*c*, and 4*d* to the use-side units 3*a*, 3*b*, 3*c*, and 3*d*) respectively. The refrigerant sent to the use-side units 3*a*, 3*b*, 3*c*, and 3*d* is sent to the use-side heat exchangers 52*a*, 52*b*, 52*c*, and 52*d*, respectively. The high-pressure refrigerant sent to the use-side heat exchangers 52*a*, 52*b*, 52*c*, and 52*d* condenses by being cooled by exchanging heat with indoor air supplied from inside the room by the use-side fans 55*a*, 55*b*, 55*c*, and 55*d* in the use-side heat exchangers 52*a*, 52*b*, 52*c*, and 52*d* that function as refrigerant radiators, respectively. The condensed refrigerant is decompressed by the use-side expansion valves 51*a*, 51*b*, 51*c*, and 51*d*, and then flows out of the use-side units 3*a*, 3*b*, 3*c*, and 3*d*, respectively. Meanwhile, the indoor air heated by the use-side heat exchangers 52*a*, 52*b*, 52*c*, and 52*d* is sent into the room, thereby heating the room.

The refrigerant flowing out of the use-side units 3*a*, 3*b*, 3*c*, and 3*d* is sent to the relay units 4*a*, 4*b*, 4*c*, and 4*d* through the second branch pipes 5*aa*, 5*bb*, 5*cc*, and 5*dd* (portion of the liquid-refrigerant connection pipe 5 that connects the relay units 4*a*, 4*b*, 4*c*, and 4*d* to the use-side units 3*a*, 3*b*, 3*c*, and 3*d*), respectively. The refrigerant sent to the relay units 4*a*, 4*b*, 4*c*, and 4*d* flows out of the relay units 4*a*, 4*b*, 4*c*, and 4*d* through the liquid relay cutoff valves 71*a*, 71*b*, 71*c*, and 71*d*, respectively.

The refrigerant flowing out of the relay units 4*a*, 4*b*, 4*c*, and 4*d* is sent to the heat source-side unit 2 in a combined state through the liquid-refrigerant connection pipe 5 (combined pipe and first branch pipes 5*a*, 5*b*, 5*c*, and 5*d*). The refrigerant sent to the heat source-side unit 2 is sent to the heat source-side expansion valve 25 through the liquid-side shutoff valve 27 and the refrigerant cooler 45. The refrigerant sent to the heat source-side expansion valve 25 is decompressed by the heat source-side expansion valve 25 and then is sent to the heat source-side heat exchanger 23. The refrigerant sent to the heat source-side heat exchanger 23 evaporates by being heated by exchanging heat with the outdoor air supplied by the heat source-side fan 24. The evaporated refrigerant is sucked into the compressor 21 through the switching mechanism 22 and the accumulator 29.

(3) Operation of Air Conditioner When Refrigerant Leaks

Next, the operation of the air conditioner 1 when the refrigerant leaks will be described with reference to the flowchart shown in FIG. 3. Note that in a similar manner to the basic operation when the refrigerant leaks described above, the air conditioner 1 described below is operated by the control unit 19 that controls components of the air conditioner 1 (heat source-side unit 2, use-side units 3*a*, 3*b*, 3*c*, and 3*d*, and relay units 4*a*, 4*b*, 4*c*, and 4*d*).

Since similar control is performed regardless of which of the use-side units 3*a*, 3*b*, 3*c*, and 3*d* causes a refrigerant leakage, the description here takes the case where a refrigerant leakage into a room where the use-side unit 3*a* is installed is detected as an example.

Figure 3:
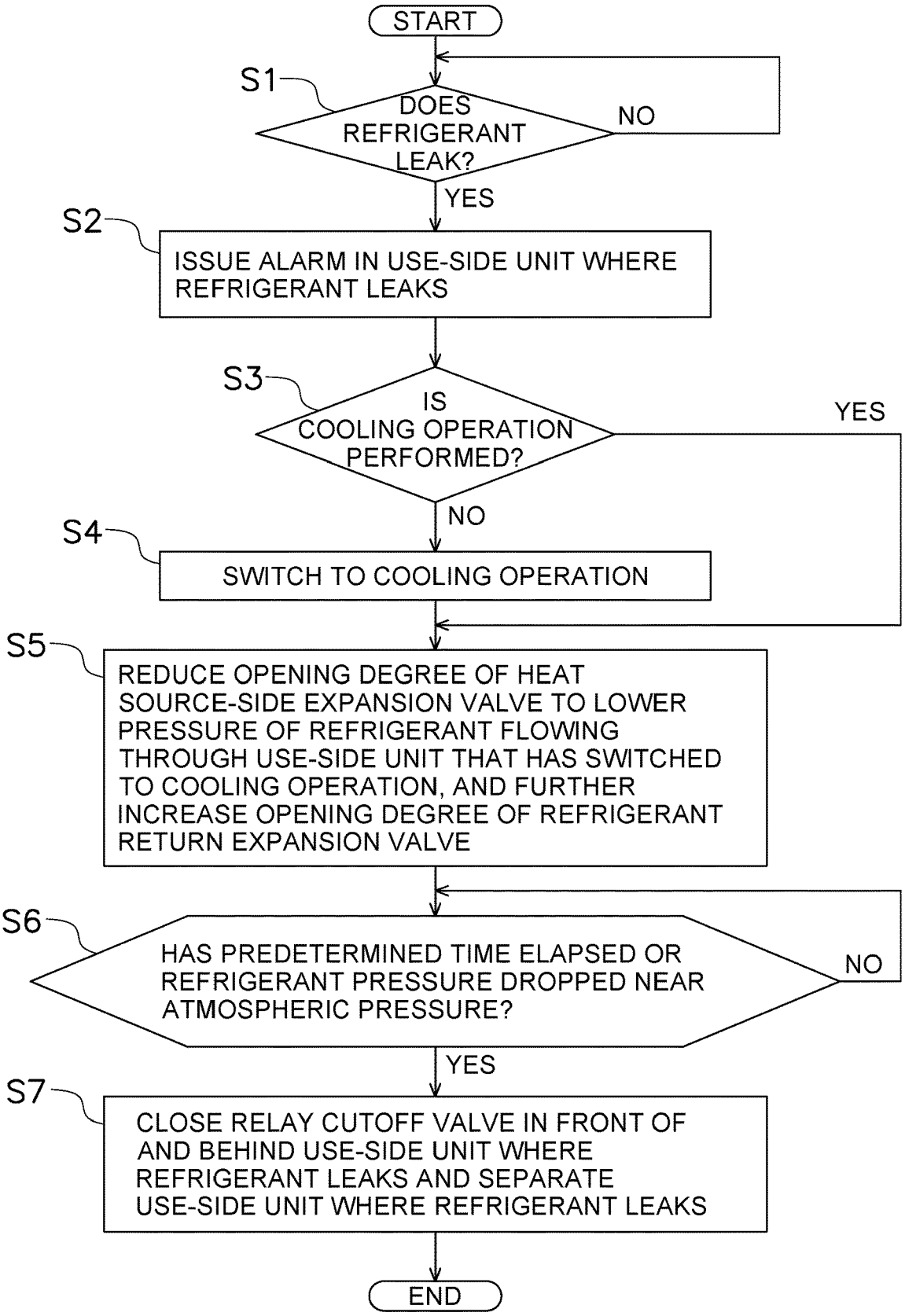
FIG. 3 is a diagram showing a control flow for dealing with a refrigerant leakage.

In step S1 of FIG. 3, the control unit 19 determines whether either of the refrigerant leakage detection units 79*a*, 79*b*, 79*c*, and 79*d* of the use-side units 3*a*, 3*b*, 3*c*, and 3*d* has detected a refrigerant leakage. Here, when the refrigerant leakage detection unit 79*a* of the use-side unit 3*a* detects a refrigerant leakage into the installation space (indoor) of the use-side unit 3*a*, the process moves to the next step S2.

In step S2, in the use-side unit 3*a* where the refrigerant leakage occurs, the control unit 19 issues an alarm to a person in the installation space of the use-side unit 3*a* by using an alarm device (not shown) that issues an alarm with an alarm sound such as a buzzer and turns on light.

Next, in step S3, the control unit 19 determines whether the use-side unit 3*a* is performing the cooling operation. Here, when the use-side unit 3*a* is performing the heating operation, or when the use-side unit 3*a* is in a stopped or suspended state in which neither cooling nor heating is performed, the process moves from step S3 to step S4.

In step S4, the use-side unit 3*a* performs the cooling operation in order to lower the pressure of the refrigerant of the use-side unit 3*a*. However, unlike the normal cooling operation, the cooling operation in step S4 is an operation of giving priority to lowering the refrigerant pressure of the use-side unit 3*a*. When the air conditioner 1 is performing the heating operation, the state of the switching mechanism 22 is switched to the cooling operation state, and the air conditioner 1 performs the cooling operation. When the use-side unit 3*a* is in a stopped or suspended state, the use-side unit 3*a* is put into the cooling operation state to lower the refrigerant pressure of the use-side unit 3*a*.

Following step S4, in step S5, the control unit 19 reduces the opening degree of the heat source-side expansion valve 25 of the heat source-side unit 2. In the normal cooling operation, the heat source-side expansion valve 25 is fully opened, but here, the opening degree of the heat source-side expansion valve 25 is reduced to lower the pressure of the refrigerant flowing to the use-side units 3*a*, 3*b*, 3*c*, and 3*d*. Note that the use-side expansion valve 51*a* of the use-side unit 3*a* is in a fully open state.

In step S5, the control unit 19 makes the opening degree of the refrigerant return expansion valve 44 larger than in the normal cooling operation to increase the amount of refrigerant flowing through the refrigerant return pipe 41 that functions as a bypass route. With this operation, out of the refrigerant that radiates heat and condenses in the heat source-side heat exchanger 23 and heads for the use-side units 3*a*, 3*b*, 3*c*, and 3*d*, more refrigerant returns to the suction side of the compressor 21 through the refrigerant return pipe 41. In other words, the amount of refrigerant that radiates heat, condenses in the heat source-side heat exchanger 23, and heads for the use-side units 3*a*, 3*b*, 3*c*, and 3*d* is reduced. By this control, the pressure of the refrigerant of the use-side unit 3*a* in which the refrigerant is leaking is reduced more quickly. The refrigerant flowing through the refrigerant return pipe 41 flows into the accumulator 29. A part of the inflowing refrigerant is accumulated in the accumulator 29.

Furthermore, in step S5, the number of revolutions of the use-side fan 55*a* is also lowered.

In step S6, the control unit 19 determines whether the pressure of the refrigerant of the use-side unit 3*a* has dropped sufficiently based on sensor values of the use-side heat exchange liquid-side sensor 57*a* and the use-side heat exchange gas-side sensor 58*a* of the use-side unit 3*a*. When the control unit 19 determines that the sensor values satisfy predetermined conditions and the pressure of the refrigerant of the use-side unit 3*a* has sufficiently dropped, the process moves from step S6 to step S7. In step S6, the passage of time is also monitored, and if a predetermined time has elapsed after executing step S5, the control unit 19 determines that the pressure of the refrigerant of the use-side unit 3*a* has dropped to some extent, and the process moves to step S7.

Note that in step S6, the control unit 19 monitors the pressure of the refrigerant of the use-side unit 3*a*, and substantially controls the pressure of the refrigerant in the use-side unit 3*a* from becoming lower than the atmospheric pressure. The process moves from step S6 to step S7 before the pressure of the refrigerant in the use-side unit 3*a* becomes lower than the atmospheric pressure.

In step S7, the control unit 19 closes the liquid relay cutoff valve 71*a* and the gas relay cutoff valve 68*a* of the relay unit 4*a* corresponding to the use-side unit 3*a* where the refrigerant leaks. This separates the use-side unit 3*a* from the refrigerant circuit 10 in which the refrigerant circulates, stops inflow of the refrigerant from the heat source-side unit 2 to the use-side unit 3*a*, and stops outflow of the refrigerant and the like from the use-side unit 3*a* to the heat source-side unit 2 side.

(4) Feature of Air Conditioner 4-1

The air conditioner 1 includes the relay units 4*a*, 4*b*, 4*c*, and 4*d*, the liquid relay cutoff valves 71*a*, 71*b*, 71*c*, and 71*d* are provided in the liquid connection pipes 61*a*, 61*b*, 61*c*, and 61*d*, and the gas relay cutoff valves 68*a*, 68*b*, 68*c*, and 68*d* are provided in the gas connection pipes 62*a*, 62*b*, 62*c*, and 62*d*, respectively. This allows the use-side unit 3*a*, 3*b*, 3*c*, and 3*d* to be separated from the heat source-side unit 2 if the refrigerant leaks from the use-side unit 3*a*, 3*b*, 3*c*, and 3*d*. If either the refrigerant leakage detection unit 79*a*, 79*b*, 79*c*, or 79*d* detects a refrigerant leakage, the control unit 19 performs pressure reduction control to lower the refrigerant pressure in the corresponding use-side unit 3*a*, 3*b*, 3*c*, and 3*d*, respectively (see steps S4 and S5 of FIG. 3). After the pressure reduction control, the control unit 19 closes the cutoff valve of the relay unit 4*a*, 4*b*, 4*c*, and 4*d* corresponding to the use-side unit 3*a*, 3*b*, 3*c*, and 3*d* in which the refrigerant leakage is detected, respectively.

Therefore, in the air conditioner 1, for example, when a refrigerant leakage from the use-side unit 3*a* is detected, first, the pressure reduction control shown in steps S4 and S5 of FIG. 3 is performed, and the refrigerant pressure in the use-side unit 3*a* is lowered. This reduces the pressure difference between the installation space of the use-side unit 3*a* and the refrigerant of the use-side unit 3*a*, and reduces the leakage speed of the refrigerant. Then, natural ventilation in the installation space of the use-side unit 3*a* discharges most of the leaked refrigerant to the outside.

Furthermore, in the air conditioner 1, after the pressure reduction control, the liquid relay cutoff valve 71*a* and the gas relay cutoff valve 68*a* of the relay unit 4*a* enter into the cutoff state (closed state). This eliminates the inflow of the refrigerant from the heat source-side unit 2, and after a while, the refrigerant leakage from the use-side unit 3*a* completely stops.

In this way, in the air conditioner 1, safety when the refrigerant leaks is very high.

4-2

In the air conditioner 1, the relay units 4*a*, 4*b*, 4*c*, and 4*d* include not only the liquid relay cutoff valves 71*a*, 71*b*, 71*c*, and 71*d*, but also the gas relay cutoff valves 68*a*, 68*b*, 68*c*, and 68*d*, respectively. Therefore, the air conditioner 1 can completely separate each of the use-side units 3*a*, 3*b*, 3*c*, and 3*d* from the heat source-side unit 2. This can eliminate the inflow of refrigerant from the heat source-side unit 2 into the use-side units 3*a*, 3*b*, 3*c*, and 3*d* and the inflow of refrigerant, air, or the like from the use-side units 3*a*, 3*b*, 3*c*, and 3*d* into the heat source-side unit 2. Therefore, even if indoor air is mixed into the refrigerant pipes of the use-side units 3*a*, 3*b*, 3*c*, and 3*d* from the refrigerant leakage location, the air does not flow into the refrigerant circuit 10 after the gas relay cutoff valves 68*a*, 68*b*, 68*c*, and 68*d* are closed.

4-3

The air conditioner 1 determines whether either of the first condition that a predetermined time has elapsed after starting the pressure reduction control or the second condition that the pressure of the refrigerant in the use-side unit where the refrigerant has leaked has dropped to near the atmospheric pressure is satisfied in step S6 of FIG. 3. Then, if either of the conditions is satisfied, the air conditioner 1 recognizes that the pressure of the refrigerant has dropped to some extent or sufficiently, and closes the cutoff valve to disconnect the use-side unit where the refrigerant has leaked from the refrigerant circuit 10.

This can reduce the defect that, in a state where the pressure of the refrigerant in the use-side unit has not dropped sufficiently, the cutoff valve is closed early, and a large amount of refrigerant leaks into the installation space of the use-side unit.

4-4

In the air conditioner 1, in step S6 of FIG. 3, in the pressure reduction control to lower the pressure of the refrigerant in the use-side unit 3*a*, the control unit 19 controls the pressure of the refrigerant in the use-side unit 3*a* from becoming smaller than the atmospheric pressure. In other words, the control unit 19 performs control to maintain the pressure of the refrigerant in the use-side unit 3*a* equal to or higher than the atmospheric pressure. This reduces the defect that air enters from a refrigerant leakage location of the use-side unit 3*a*, for example, a crack location of the refrigerant pipe, and that the air flows into the refrigerant connection pipe 5 or 6 or the heat source-side unit 2.

4-5

In the air conditioner 1, as shown in step S5 of FIG. 3, in the pressure reduction control to lower the pressure of the refrigerant in the use-side unit 3*a*, the control unit 19 increases the degree of decompression of the refrigerant by the heat source-side expansion valve 25 to lower the pressure of the refrigerant flowing from the heat source-side unit 2 to the use-side unit 3*a*. This quickly lowers the pressure of the refrigerant in the use-side unit 3*a*.

Note that the pressure of the refrigerant flowing through the use-side unit 3*a* is lowered by reducing the opening degree of the heat source-side expansion valve 25 instead of the use-side expansion valve 51*a* of the use-side unit 3*a*, thereby lowering the pressure of the refrigerant of the entire use-side unit 3*a*. Therefore, no matter where the refrigerant leaks from the use-side unit 3*a*, the leakage speed can be reliably reduced.

4-6

In the air conditioner 1, the heat source-side unit 2 includes the refrigerant return pipe 41 as a bypass route. The refrigerant return pipe 41 can return a part of the refrigerant discharged from the compressor 21 and heat is radiated by the heat source-side heat exchanger 23 to the suction side of the compressor 21 without passing through the use-side units 3*a*, 3*b*, 3*c*, and 3*d*. Upon detection of a refrigerant leakage from the use-side unit 3*a*, as shown in step S5 of FIG. 3, the control unit 19 performs the pressure reduction control to lower the refrigerant pressure in the use-side unit 3*a*, opens the refrigerant return expansion valve 44 of the refrigerant return pipe 41, and uses the refrigerant return pipe 41 to return the refrigerant to the compressor 21. This reduces the amount of refrigerant flowing from the heat source-side unit 2 to the use-side unit 3*a*, and rapidly lowers the pressure of the refrigerant in the use-side unit 3*a*. The refrigerant flowing through the refrigerant return pipe 41 flows into the accumulator 29. This allows some of the inflowing refrigerant to be accumulated in the accumulator 29, reduces the amount of refrigerant flowing from the heat source-side unit 2 to the use-side unit 3*a*, and rapidly lowers the pressure of the refrigerant in the use-side unit 3*a*.

4-7

In the air conditioner 1, in step S5 described above, the control unit 19 lowers the number of revolutions of the use-side fan 55*a*. This can reduce the degree of superheating of the suction refrigerant of the compressor 21, and the temperature of the discharge refrigerant of the compressor 21 drops. Accordingly, it is possible to inhibit an increase in the degree of superheating of the suction refrigerant of the compressor 21 caused by a decrease in the refrigerant pressure of the use-side unit 3*a*.

(5) Modifications (5-1) Modification A

In the air conditioner 1 of the above-described embodiment, the liquid relay cutoff valves 71*a*, 71*b*, 71*c*, and 71*d* and the gas relay cutoff valves 68*a*, 68*b*, 68*c*, and 68*d* are electric expansion valves, but an electromagnetic valve that switches between the open state and the closed state may be adopted.

(5-2) Modification B

The air conditioner 1 of the above-described embodiment controls the flow rate of the refrigerant flowing through each of the use-side units 3*a*, 3*b*, 3*c*, and 3*d* by decompression in the use-side expansion valves 51*a*, 51*b*, 51*c*, and 51*d*, respectively, in the basic operation (cooling operation and heating operation), but is not limited to this example. For example, by using the fact that the liquid relay cutoff valves 71*a*, 71*b*, 71*c*, and 71*d* of the relay units 4*a*, 4*b*, 4*c*, and 4*d* are electric expansion valves, the flow rate of the refrigerant flowing through the use-side units 3*a*, 3*b*, 3*c*, and 3*d* may be controlled by the decompression in the liquid relay cutoff valves 71*a*, 71*b*, 71*c*, and 71*d* instead of decompression in the use-side expansion valves 51*a*, 51*b*, 51*c*, and 51*d*, respectively.

Similarly, when the refrigerant leaks, in step S5 of FIG. 3, by reducing the opening degree of the heat source-side expansion valve 25 of the heat source-side unit 2, the pressure of the refrigerant flowing through the use-side unit 3*a* where the refrigerant leaks is lowered, but instead of this way, the pressure of the refrigerant flowing through the use-side unit 3*a* may be lowered by reducing the opening degree of the liquid relay cutoff valve 71*a* of the relay unit 4*a*.

(5-3) Modification C

The air conditioner 1 of the above-described embodiment adopts the relay units 4*a*, 4*b*, 4*c*, and 4*d* in which the liquid-side configuration and the gas-side configuration are integrated, but the relay units may be configured with separate liquid-side configuration and gas-side configuration.

(5-4) Modification D

In step S7 of the air conditioner 1 of the above-described embodiment, after closing the liquid relay cutoff valve 71*a* and the gas relay cutoff valve 68*a* to separate the use-side unit 3*a* where the refrigerant leaks from the refrigerant circuit 10, the operation of the other use-side units 3*b*, 3*c*, and 3*d* may be continued, or the entire air conditioner 1 may be stopped.

If the operation of the other use-side units 3*b*, 3*c*, and 3*d* continues, the operation of the other use-side units 3*b*, 3*c*, and 3*d* and the heat source-side unit 2 is returned to the operation before the refrigerant leakage is detected.

When the entire air conditioner 1 is stopped, in step S7, for example, the liquid relay cutoff valves 71*b*, 71*c*, and 71*d* and the gas relay cutoff valves 68*b*, 68*c*, and 68*d* of the relay units 4*b*, 4*c*, and 4*d* are further all closed. Then, the compressor 21 of the heat source-side unit 2 is also stopped.

(5-5) Modification E

In step S4 of the air conditioner 1 of the above-described embodiment, the use-side expansion valve 51*a* of the use-side unit 3*a* where the refrigerant leaks is in a fully open state. Furthermore, the use-side expansion valves 51*b*, 51*c*, and 51*d* of the use-side units 3*b*, 3*c*, and 3*d* where no refrigerant leaks are also preferably in a fully opened state.

(5-6) Modification F

When it is determined that the cooling operation is performed in step S3 of the air conditioner 1 of the above-described embodiment and the process moves to step S5, in step S5, furthermore, the liquid relay cutoff valves 71*b*, 71*c*, and 71*d* and the gas relay cutoff valves 68*b*, 68*c*, and 68*d* of the relay units 4*b*, 4*c*, and 4*d* corresponding to the use-side units 3*b*, 3*c*, and 3*d* where no refrigerant leaks are preferably all closed, respectively. This is because when the cooling operation is performed, the liquid phase refrigerant is supplied to the other use-side units 3*b*, 3*c*, and 3*d*, and the purpose is to confine the supplied refrigerant in the use-side units 3*b*, 3*c*, and 3*d*. If the liquid refrigerant is confined in the use-side unit 3*b*, 3*c*, and 3*d*, the amount of refrigerant flowing through the use-side unit 3*a* where the refrigerant leaks is reduced.

Meanwhile, when it is determined in step S3 of the air conditioner 1 of the above-described embodiment that the heating operation is performed, if the liquid relay cutoff valves 71*b*, 71*c*, and 71*d* and the gas relay cutoff valves 68*b*, 68*c*, and 68*d* of the relay units 4*b*, 4*c*, and 4*d* corresponding to the use-side units 3*b*, 3*c*, and 3*d* without refrigerant leakage are closed, respectively, the final stage is preferable as the closing timing. For example, in step S7, after separating the use-side unit 3*a* from the refrigerant circuit 10 through which the refrigerant circulates, the liquid relay cutoff valves 71*b*, 71*c*, and 71*d* and the gas relay cutoff valves 68*b*, 68*c*, and 68*d* are preferably closed.

(5-7) Modification G

The air conditioner 1 of the above-described embodiment uses R32 as the refrigerant. When a single refrigerant of R32, R1234yf, R1234ze, or R744, or a mixed refrigerant including the refrigerant is used, the control of the air conditioner when the refrigerant leakage of (3) described above is detected functions effectively.

Note that R32 described above is difluoromethane (HFC-32), R1234yf is 2,3,3,3-tetrafluoro-1-propene (HFO-1234yf, R1234ze is 1,3,3,3-tetrafluoro-1-propene (HFO-1234ze), and R744 is carbon dioxide.

The embodiment of the present disclosure has been described above. It will be appreciated that various modifications to modes and details can be made without departing from the spirit and the scope of the present disclosure described in the appended claims.

REFERENCE SIGNS LIST

1: air conditioner (refrigerant cycle apparatus)
2: heat source-side unit
3*a*: use-side unit
3*b*: use-side unit
3*c*: use-side unit
3*d*: use-side unit
5: liquid-refrigerant connection pipe
6: gas-refrigerant connection pipe
19: control unit
21: compressor
23: heat source-side heat exchanger
25: heat source-side expansion valve (heat source-side expansion mechanism)
41: refrigerant return pipe (bypass route)
68*a*: gas relay cutoff valve (second cutoff valve)
68*b*: gas relay cutoff valve (second cutoff valve)
68*c*: gas relay cutoff valve (second cutoff valve)
68*d*: gas relay cutoff valve (second cutoff valve)
71*a*: liquid relay cutoff valve (first cutoff valve)
71*b*: liquid relay cutoff valve (first cutoff valve)
71*c*: liquid relay cutoff valve (first cutoff valve)
71*d*: liquid relay cutoff valve (first cutoff valve)
79*a*: refrigerant leakage detection unit
79*b*: refrigerant leakage detection unit
79*c*: refrigerant leakage detection unit
79*d*: refrigerant leakage detection unit

CITATIONS LIST

Patent Literature

Patent Literature 1: JP 2014-35171 A

The invention claimed is:

1. A refrigerant cycle apparatus comprising:

a use-side unit;

a heat source-side unit including a heat source-side expansion valve;

refrigerant connection pipes connecting the use-side unit to the heat source-side unit;

a cutoff valve assembly provided in the refrigerant connection pipes and configured to cut off inflow of a refrigerant into the use-side unit;

a refrigerant leakage detector configured to detect leakage of the refrigerant from the use-side unit; and a controller configured to perform pressure reduction control, when the refrigerant leakage detector detects the leakage of the refrigerant, to lower pressure of the refrigerant in the use-side unit and thereafter put the cutoff valve assembly into a cutoff state, wherein in the pressure reduction control, the controller lowers the pressure of the refrigerant flowing from the heat source-side unit to the use-side unit by reducing an opening degree of the heat source-side expansion valve, after the pressure reduction control lowers the pressure of the refrigerant in the use-side unit and reduces a pressure difference between an installation space of the use-side unit and the pressure of the refrigerant in the use-side unit to thereby reduce a speed of the leakage of the refrigerant from the use-side unit, the controller puts the cutoff valve assembly into a cutoff state, the refrigerant connection pipes include a high pressure-side first refrigerant connection pipe and a low pressure-side second refrigerant connection pipe, the cutoff valve assembly includes a first cutoff valve provided in the first refrigerant connection pipe and a second cutoff valve provided in the second refrigerant connection pipe, and the controller is configured to put both of the first cutoff valve and second cutoff valve into the cutoff state after performance of the pressure reduction control.

2. The refrigerant cycle apparatus according to claim 1, wherein when the refrigerant leakage detector detects the leakage of the refrigerant, the controller performs the pressure reduction control to lower the pressure of the refrigerant in the use-side unit, and thereafter puts the cutoff valve assembly into the cutoff state when a predetermined time elapses.

3. The refrigerant cycle apparatus according to claim 1, wherein when the refrigerant leakage detector detects the leakage of the refrigerant, the controller performs the pressure reduction control to lower the pressure of the refrigerant in the use-side unit, and thereafter puts the cutoff valve assembly into the cutoff state when the pressure of the refrigerant or a temperature of the refrigerant in the use-side unit satisfies a predetermined condition.

4. The refrigerant cycle apparatus according to claim 1, wherein in the pressure reduction control to lower the pressure of the refrigerant in the use-side unit, the controller performs control to prevent the pressure of the refrigerant in the use-side unit from becoming lower than atmospheric pressure.

5. The refrigerant cycle apparatus according to claim 1, wherein as the refrigerant, a single refrigerant of R32, R1234yf, R1234ze, or R744, or a mixed refrigerant including the refrigerant is used.

6. A refrigerant cycle apparatus comprising:

a use-side unit;

a heat source-side unit;

refrigerant connection pipes connecting the use-side unit to the heat source-side unit;

a cutoff valve assembly provided in the refrigerant connection pipes and configured to cut off inflow of a refrigerant into the use-side unit;

a refrigerant leakage detector configured to detect leakage of the refrigerant from the use-side unit; and a controller configured to perform pressure reduction control, when the refrigerant leakage detector detects the leakage of the refrigerant, to lower pressure of the refrigerant in the use-side unit and thereafter put the cutoff valve assembly into a cutoff state, wherein the heat source-side unit includes:

a compressor;

a heat source-side heat exchanger configured to radiate heat from the refrigerant discharged from the compressor; and a bypass route configured to return a part of the refrigerant discharged from the compressor and from which heat is radiated by the heat source-side heat exchanger to the compressor without going through the use-side unit, in the pressure reduction control, the controller reduces an amount of the refrigerant flowing from the heat source-side unit to the use-side unit by returning the refrigerant to the compressor by using the bypass route.

7. The refrigerant cycle apparatus according to claim 2, wherein when the refrigerant leakage detector detects the leakage of the refrigerant, the controller performs the pressure reduction control to lower the pressure of the refrigerant in the use-side unit, and thereafter puts the cutoff valve assembly into the cutoff state when the pressure of the refrigerant or a temperature of the refrigerant in the use-side unit satisfies a predetermined condition.

8. The refrigerant cycle apparatus according to claim 2, wherein in the pressure reduction control to lower the pressure of the refrigerant in the use-side unit, the controller performs control to prevent the pressure of the refrigerant in the use-side unit from becoming lower than atmospheric pressure.

9. The refrigerant cycle apparatus according to claim 3, wherein in the pressure reduction control to lower the pressure of the refrigerant in the use-side unit, the controller performs control to prevent the pressure of the refrigerant in the use-side unit from becoming lower than atmospheric pressure.

10. The refrigerant cycle apparatus according to claim 2, wherein as the refrigerant, a single refrigerant of R32, R1234yf, R1234ze, or 8744, or a mixed refrigerant including the refrigerant is used.

11. The refrigerant cycle apparatus according to claim 3, wherein as the refrigerant, a single refrigerant of R32, R1234yf, R1234ze, or 8744, or a mixed refrigerant including the refrigerant is used.

12. The refrigerant cycle apparatus according to claim 4, wherein as the refrigerant, a single refrigerant of R32, R1234yf, R1234ze, or R744, or a mixed refrigerant including the refrigerant is used.

* * * * *